US007935387B2

(12) United States Patent
Lee et al.

(10) Patent No.: US 7,935,387 B2
(45) Date of Patent: May 3, 2011

(54) METHODS FOR FABRICATING YAG BARRIER COATINGS

(75) Inventors: Hee Dong Lee, Centerville, OH (US); Tai-Il Mah, Centerville, OH (US)

(73) Assignee: UES, Inc., Dayton, OH (US)

( * ) Notice: Subject to any disclaimer, the term of this patent is extended or adjusted under 35 U.S.C. 154(b) by 1187 days.

(21) Appl. No.: 11/253,352

(22) Filed: Oct. 19, 2005

(65) Prior Publication Data

US 2008/0008839 A1 Jan. 10, 2008

Related U.S. Application Data

(60) Provisional application No. 60/620,617, filed on Oct. 20, 2004.

(51) Int. Cl.
*C23C 30/00* (2006.01)

(52) U.S. Cl. ..... 427/419.2; 427/419.3

(58) Field of Classification Search ..... 427/248.1, 427/250–253, 255.28–255.394, 421.1, 402, 427/419.1–419.3

See application file for complete search history.

(56) References Cited

U.S. PATENT DOCUMENTS

| | | | | |
|---|---|---|---|---|
| 5,665,463 | A | 9/1997 | Morgan et al. | |
| 5,863,668 | A | 1/1999 | Brindley et al. | |
| 6,015,630 | A * | 1/2000 | Padture et al. | 428/632 |
| 6,060,177 | A * | 5/2000 | Bornstein et al. | 428/623 |
| 6,365,281 | B1 | 4/2002 | Subramanian et al. | |
| 6,444,259 | B1 | 9/2002 | Subramanian et al. | |
| 6,528,190 | B1 | 3/2003 | Campbell et al. | |
| 6,733,907 | B2 | 5/2004 | Morrison et al. | |
| 6,863,999 | B1 * | 3/2005 | Sudre et al. | 428/704 |
| 2004/0001977 | A1 * | 1/2004 | Subramanian | 428/702 |
| 2004/0156724 | A1 | 8/2004 | Torigoe et al. | |
| 2006/0121296 | A1 * | 6/2006 | Morrison et al. | 428/469 |

OTHER PUBLICATIONS

Chen et al., "Synthesis and characterization of lanthanum phosphate sol for fibre coating," Journal of Materials Science 32 (1997) 3863-3867.*

Mah et al., "Polycrystalline YAG; structural or functional?" Journal of Ceramic Processing Research, vol. 5, No. 4, pp. 369-379 (2004).*

Heffelfinger et al., "Evolution of yttrium aluminum garnet films by solid-state reaction," Mat. Res. Soc. Symp. Proc. vol. 317 (1994) 553-558.*

Haynes et al., "Oxidation and degradation of a plasma-sprayed thermal barrier coating system," Surface and Coatings Technology 86-87 (1996) 102-108.*

Hirano, "Application of eutectic composites to gas turbine system and fundamental fracture properties up to 1700° C.," Journal of the European Ceramic Society 25 (2005) 1191-1199.*

Wu et al., "Novel Deposition of Y3AI5O12 Coatings by Electrostatic Spray-Assisted Vapor Deposition," J. Am. Ceram. Soc., 89 [1] 385-387 (2006).*

* cited by examiner

*Primary Examiner* — William Philip Fletcher, III
(74) *Attorney, Agent, or Firm* — Dinsmore & Shohl LLP

(57) ABSTRACT

Method embodiments for coating alloys comprise providing a superalloy substrate, applying a bond coat onto the superalloy substrate, forming an oxidation barrier coating comprising an yttrium aluminum garnet (YAG) phase on the bond coat, and depositing a top coat on the oxidation barrier coating.

24 Claims, 1 Drawing Sheet

METHODS FOR FABRICATING YAG BARRIER COATINGS

CROSS-REFERENCE TO RELATED APPLICATIONS

This application claims the benefit of U.S. Provisional Application Ser. No. 60/620,617, filed Oct. 20, 2004.

BACKGROUND OF THE INVENTION

The present invention relates to coated alloys and methods of making coated alloys, and specifically relates to coated alloys operable to withstand oxidation at high temperatures i.e. temperatures above about 1000° C.

SUMMARY OF THE INVENTION

According to a first embodiment, a coated alloy is provided. The coated alloy comprises a superalloy substrate, a bond coat comprising a metallic alloy disposed on the superalloy substrate, an oxidation barrier coating comprising yttrium aluminum garnet (YAG) disposed on the bond coat, and a top coat defining the outermost layer disposed on the oxidation barrier coating.

According to a second embodiment, a method of forming a coated alloy is provided. The method comprises providing a superalloy substrate, applying a bond coat onto the superalloy substrate, providing an yttrium oxide film and an aluminum oxide film, and reacting the yttrium and aluminum oxide films at a temperature effective to form an oxidation barrier coating onto the bond coat, wherein the oxidation barrier coating comprises an yttrium aluminum garnet (YAG) phase. The method further comprises depositing a top coat on the oxidation barrier coating.

According to a third embodiment, a method of forming a coated alloy is provided. The method comprises providing a superalloy substrate, and applying a bond coat onto the superalloy substrate, wherein the bond coat comprises a surface layer comprising a preformed aluminum oxide film. The method also comprises depositing an yttrium oxide film onto the surface layer of the bond coat, and reacting the yttrium oxide film with the preformed aluminum oxide films at a temperature effective to form an oxidation barrier coating onto the bond coat, wherein the oxidation barrier coating comprises an yttrium aluminum garnet (YAG) phase. The method further comprises depositing a top coat onto the oxidation barrier coating.

According to a fourth embodiment, a method of forming a coated alloy is provided. The method comprises providing a superalloy substrate, applying a bond coat comprising aluminum onto the superalloy substrate, and depositing an yttrium oxide film onto the surface of the bond coat. The method also comprises reacting the yttrium oxide film and the aluminum in the bond coat in an oxidizing atmosphere at a temperature effective to form an oxidation barrier coating onto the bond coat, wherein the oxidation barrier coating comprises an yttrium aluminum garnet (YAG) phase. The method further comprises depositing a top coat onto the oxidation barrier coating.

According to the present invention, the coated alloys, and methods of making the coating alloys, especially in the ability to withstand oxidation at higher temperatures, for example, temperatures above about 1000° C. These and additional objects and advantages provided by the coated alloys, and the methods of making the coated alloys will be more fully understood in view of the following detailed description.

BRIEF DESCRIPTION OF THE DRAWINGS

The following detailed description of specific embodiments of the present invention can be best understood when read in conjunction with the drawings enclosed herewith. The drawing sheets include.

DETAILED DESCRIPTION

Figure 1:
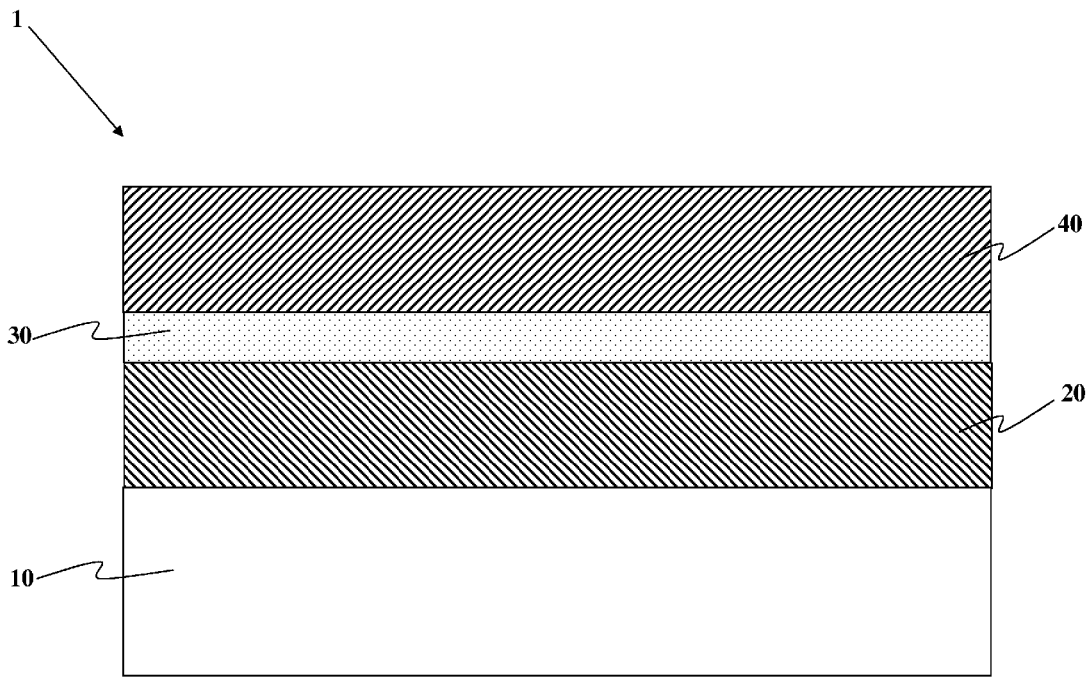
FIG. 1 is schematic view illustrating a coated alloy according to one or more embodiments of the present invention.

Referring to FIG. 1, a coated alloy 1 is provided. The coated alloy 1 comprises a superalloy substrate 10, a bond coat alloy 20 disposed on the superalloy substrate 20, an oxidation barrier coating 30 comprising yttrium aluminum garnet (YAG) disposed on the bond coat, and a top coat 40 defining the outermost layer disposed on the oxidation barrier coating 30. As defined herein, "on" means directly on the underlying layer without any intervening layers.

A superalloy 10 is a high temperature alloy, which exhibits superior mechanical properties, such as good surface stability, and corrosion resistance. The superalloy 10 can withstand high temperatures, for example, temperatures above about 1000° C. and substantially reduce oxidation, thereby maintaining the mechanical properties of the superalloy. Superalloys are applicable in numerous commercial and industrial applications, e.g. turbine components. The superalloy substrate 10 may comprise any metal suitable to withstand oxidation and cracking at high temperatures. Examples of suitable metals include, but are not limited to, nickel, cobalt, iron, chromium, molybdenum, tungsten, aluminum, zirconium, niobium, rhenium, carbon, silicon or combinations thereof. In one exemplary embodiment, the superalloy substrate 10 comprises nickel.

The bond coat 20, which is disposed on the superalloy substrate 10, comprises a metallic alloy operable to bond the superalloy substrate 10 to the oxidation barrier coating 20. The bond coat 20 may comprise any suitable metal operable to promote the desired bonding strength. In one embodiment, the bond coat alloy 20 may comprise MCrAlY wherein M comprises Ni, Co or combinations thereof. In another embodiment, the bond coat alloy 20 may comprise MAl wherein M comprises Ni, Pt, Co, NiCo or combinations thereof. In yet another embodiment, the bond coat 20 alloy may comprise $M_3Al$ wherein M comprises Ni, Co, NiCo or combinations thereof. The bond coat may further comprises any alloy including up to about 50% by wt. aluminum, an in one embodiment, at least 10% by wt aluminum in the bond coat 20. Depending on the alloy application, a variety of bond coat 20 thicknesses are contemplated. In one embodiment, the bond coat 20 comprises a thickness of about 25 to about 200 μm thick. The bond coat alloy 20 may be oxidation-resistant; however, generally its oxidation resistance is insufficient at withstanding oxidation in high temperature applications.

The oxidation barrier coating 30, which is disposed on the bond coat alloy 20, is configured to improve the oxidation resistance of the coated alloy 1, especially at temperatures above 1000° C. By increasing the oxidation resistance of the coated alloy 1, the oxidation barrier coating 30 may reduce the thermal spallation or layer de-lamination of layers in the alloy 1, thereby increasing the lifetime and durability of the alloy. For example, if high temperature oxidation is not reduced, the top coat 40 or portions thereof may de-laminate or separate from the oxidation barrier coating 30, the oxidation barrier coating or portions thereof may de-laminate from the bond coat, and/or the bond coat 20 or portions thereof may de-laminate from the substrate 10. The oxidation barrier also reduces cracking due to oxidation on the substrate or any additional layers. The oxidation barrier coating 30 comprises materials effective at withstanding oxidation. In one embodiment, the oxidation barrier coating 30 comprises yttrium aluminum garnet (YAG). YAG is a durable material having excellent mechanical properties, for example, low grain-boundary diffusivity of oxygen, which makes YAG a desirable material in the oxidation barrier coatings 30. For example, and not by way of limitation, YAG has a melting point of YAG of about 1970° C., a Young's modulus (E) of about 340 GPa, a hardness (Hv) of about 19 GPa, a coefficient of thermal expansion from about 8 to about 9 ppm, and YAG ($Y_3Al_5O_{12}$) belongs to a cubic crystal system. The oxidation barrier coating 30 may comprise one or more YAG phases, which generally are resistant to phase transformations. In exemplary embodiments, the oxidation barrier coating 30 may comprise single phase YAG.

In a further embodiment, the oxidation barrier coating 30 may comprise nano-sized, densely bonded primary grains of YAG. The nano-sized grains may increase the strength and structural integrity of the oxidation barrier coating 30 and the alloy 1. The nano-sized YAG grains may comprise a thickness of about 100 to about 5000 nm, and, in specific embodiments, a thickness of between about 500 nm to about 1000 nm. The oxidation barrier coating 30 may comprise any suitable thickness depending on the industrial application. In exemplary embodiments, the oxidation barrier coating 30 comprises a thickness of up to 50 μm, or in a specific embodiment a thickness of about 0.5 to about 2 μm.

The coated alloy 1 further comprises a top coat 40 disposed on the oxidation barrier coating 30. In one embodiment, the top coat 40 defines the outermost layer of the coated alloy 1. The top coat 40 may comprise any thermally stable material with a low thermal conductivity. Examples may include, but are not limited to, zirconia or yttria stabilized zirconia comprising about 7 to about 8% wt. yttria. In another embodiment, the top coat 40 comprises rare earth compositions, specifically rare earth compositions that are inert with respect to the oxidation barrier coating 30. In a further embodiment, the top coat 40 may comprise rare earth phosphates, for example, lanthanum phosphate ($LaPO_4$). Rare earth phosphates, such as $LaPO_4$, are effective top coat 40 materials, because rare earth phosphates contain low thermal conductivity, low density, high thermal stability, and chemical inertness to the YAG oxidation barrier coating 30. Accordingly, the combination of the oxidation barrier coating 30 and the top coat 40 yields improved thermal insulation efficiency, a longer alloy lifetime, and increased alloy strength and durability. The top coat 40 generally comprises a thickness of about 100 to about 500 μm; however other suitable thickness values are also contemplated depending on the desired application.

In one top coat 40 embodiment, the lanthanum phosphate comprises a thermal conductivity of about 1.5 to about 2.0 w/m·K at about 600 to about 700° C., and the lanthanum phosphate further comprises a density of about 4.0 to about 5.0 g/cm$^3$. Furthermore, lanthanum phosphate comprises a melting temperature of about 2070° C., and is resistant to phase transformation. Moreover, $LaPO_4$ is chemically compatible to other materials, e.g. yttria stabilized zirconia, thus top coat 40 blends comprising zirconia and $LaPO_4$ are contemplated herein.

The following embodiments illustrate possible methods of forming the coated alloys 1. In one embodiment, the method comprises providing a superalloy substrate 10, for example, a Ni-based superalloy, and applying a bond coat 20 comprising aluminum onto the superalloy substrate 10. The bond coat 20 may be applied using any suitable conventional technique known to one of ordinary skill in the art. These techniques may include, but are not limited to, spreading, spraying e.g., low thermal plasma spraying and thermal spraying, magnetron sputtering, low pressure plasma spraying, or any suitable vapor deposition technique, such as electron beam physical vapor deposition (EBPVD), or cathodic arc physical vapor deposition (CAPVD).

The method further comprises providing an yttrium oxide film and an aluminum oxide film, and reacting the yttrium and aluminum oxide films at a temperature effective to form an oxidation barrier coating 30 comprising a YAG phase. In one embodiment, the aluminum oxide film may be produced by oxidizing the aluminum of the bond coat 20. In accordance with this embodiment, the deposited yttrium oxide film on the surface of the bond coat 20 may react with the aluminum of the bond coat 20 in an oxidizing atmosphere e.g. in the presence of air or O2 gas to produce an in-situ interfacial reaction which results in the formation of the YAG oxidation barrier coating 30.

In another embodiment, the yttrium and aluminum oxide films are directly deposited onto the bond coat 20. The films may be directly deposited onto the bond coat 20, simultaneously, or sequentially. In one embodiment, the yttrium and aluminum oxide films may be deposited as alternating layers onto the bond coat 20.

Below are a few exemplary embodiments of the chemical reactions of the yttrium and aluminum oxides according to the method steps described above:

$$1.5Y_2O_3+5Al+3.75O_2 \rightarrow Y_3Al_5O_{12}$$

$$0.75Y_4Al_2O_9+3.5Al+2.625O_2 \rightarrow Y_3Al_5O_{12}$$

$$3YAlO_3+5Al+1.5O_2 \rightarrow Y_3Al_5O_{12}$$

In an alternative method embodiment, the deposited yttrium oxide film may react with a preformed aluminum oxide layer formed on the surface of the bond coat 20 to form the oxidation barrier coating 30. The formation of the oxidation barrier coating 30 may occur in any suitable atmosphere, for example, in a vacuum or inert gas (Ar) atmosphere. In this method, the bond coat 20 comprises a surface layer having a preformed aluminum oxide film. The preformed aluminum oxide film, which may be produced by any suitable deposition technique described above or may also be produced by a controlled oxidation in air or $O_2$ gas, may contain various thicknesses depending on the desired thickness of the oxidation barrier coating 30. In exemplary embodiments, the preformed aluminum oxide film may comprise a thickness of up to 25 μm, or alternatively about 0.1 μm to about 1 μm. In another embodiment, the preformed aluminum oxide film comprises a thickness of about 0.5 μm.

The following chemical reactions illustrate exemplary embodiments of reactions between the yttrium oxide and the preformed aluminum oxide layer:

$$1.5Y_2O_3+5Al+3.75O_2 \rightarrow Y_3Al_5O_{12}$$

$$0.75Y_4Al_2O_9+3.5Al+2.625O_2 \rightarrow Y_3Al_5O_{12}$$

$$3YAlO_3+5Al+1.5O_2 \rightarrow Y_3Al_5O_{12}$$

The yttrium and aluminum oxide films may comprise any suitable yttrium and aluminum oxides, respectively, which are effective to produce the desired reaction product, YAG. Examples of the yttrium films may include, but are not limited to, yttria ($Y_2O_3$), YAM ($Y_4Al_2O_9$), YAP ($YAlO_3$), yttrium aluminates, or combinations thereof. In one exemplary embodiment, the yttrium oxide film and the aluminum oxide film may comprise compositions of from about 0.375 to about 1.0 mole % $Y_2O_3$ and from about 0 to about 0.675 mole % $Al_2O_3$, respectively. In a further embodiment, yttria ($Y_2O_3$), YAM ($Y_4Al_2O_9$), and YAP ($YAlO_3$) may be deposited on top of bond-coat alloys where elemental aluminum with greater than 12 wt. % concentration was one of the ingredients in the bond coat 20, e.g., NiCoCrAlY and PtAl. The films may be deposited using suitable conventional techniques. Examples of these techniques may include, but are not limited to, the techniques listed above.

According to one contemplated embodiment, the deposited Y and Al films are generally dense films having thickness of up to about 25 μm, and, in exemplary embodiments, between about 0.5 and about 1.0 μm. Other suitable thicknesses are also contemplated. In further embodiments, the bond coat 20 surface may undergo various pretreatment steps prior to deposition of the oxidation barrier coating 30. For example, these pretreatment steps may include degreasing the bond coat 20 surface ultrasonically in a solvent, for example, acetone and/or isopropanol, and optionally blow drying the surface. Other techniques, such as sputter cleaning, may also be utilized.

The reaction of the yttrium and aluminum oxides may occur under any suitable processing conditions, e.g. time, temperature, and pressure that are effective to promote the formation of the oxidation barrier coating 30. The reaction temperatures may be raised to about 1300° C. In exemplary embodiments, the reaction temperature ranges from about 1000° C. to about 1200° C., for about 1 hour to about 300 hours. The reaction may be at vacuum pressures, for example, at pressures below $10^{-6}$ Torr, or at atmospheric pressure, in the presence of air or inert gases, such as argon, or in the presence of an oxidizing atmosphere, such as oxygen. In one exemplary embodiment, the reaction may occur with a temperature of about 1100° C., for a duration of about 1 hour in air followed by about 50 hours in Ar or under vacuum, and about 200 hours in air. Alternatively, the duration can be about 1 hour in air followed by about 100 to about 150 hours in Ar, and about 100 to about 150 hours in air.

After the barrier coating 30 is produced, the top coat 40 may then be applied. The top coat 40 may be applied by any suitable conventional technique, which may include, but is not limited to the above described deposition techniques. In one embodiment, the top coat 40 may comprise $LaPO_4$ synthesized by any suitable method known to one skilled in the art. In one embodiment, the fine powder of $LaPO_4$ was synthesized by hydrothermal processing at temperatures below about 130° C. using the aqueous mixtures of lanthanum and phosphorous compositions, e.g., lanthanum nitrate with alkyl phosphates. Examples of alkyl phosphates may include, but are not limited to, trimethyl and triethyl phosphates. The hydrothermal reaction may yield a more highly sinterable fine-sized $LaPO_4$ powder than other $LaPO_4$ synthesis techniques. The as-synthesized $LaPO_4$ can be further densified by, either conventional powder sintering at temperatures of from about 1400 to about 1550° C. or hot pressing at temperatures of from about 1300 to about 1450° C.

The following examples illustrate one or more feasible deposition schemes in accordance with the present invention:

Example 1

Coated Alloy Preparation Using CAPVD

Utilizing the CAPVD system, the bond coat 20 is sputter-cleaned in an Ar plasma prior to deposition by turning on the filtered arc sources in a magnetic field "off" mode and biasing the substrates to −400 V. Coated alloys comprising bond coat 20 alloy surfaces cleaned in this manner can be mounted on a planetary rotation system in the main chamber of the deposition system. During deposition, the substrates can be rotated at various speeds, for example, about 10-30 r.p.m. in order to obtain coating uniformity. Subsequently, a thin layer of yttrium can be deposited by turning off the aluminum arc target while keeping yttrium arc target and the magnetic field on. A top layer of $Y_2O_3$ can be deposited by bleeding sufficient oxygen gas into the deposition chamber. A substrate bias of about −40 V can be used during deposition of the bond layer and the $Y_2O_3$ top layer.

Alternatively, yttrium and aluminum arc targets may both be mounted as filtered arc sources. The chamber may be evacuated to a suitable base pressure, for example, about $10^{-3}$ Pa and below. Both the Al and the Y filtered arc sources are turned on with the magnetic field "on" in an oxygen atmosphere. In the deposition of YAP, the arc current in both Al and Y arc targets were kept about the same for deposition of YAP—from about 60 to about 70 amps. In the deposition of YAM, the arc current for the Y target was maintained at about 70 amps while the arc current for the Al target was maintained at about 35 amps. The pressure may be reduced during deposition, for example, between about 0.1 and about 0.5 torr during deposition. The deposition rates may also vary depending on the oxidation barrier thickness desired. In one embodiment, the deposition rate can be adjusted from about 2.0 to about 10.0 micron/hour. Subsequently, the alloy 1 temperature may be raised to a temperature of about 400° C.

It is noted that terms like "specifically" "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of forming a coated alloy comprising:

providing a superalloy substrate;

applying a bond coat onto the superalloy substrate;

depositing an yttrium oxide film and an aluminum oxide film onto the bond coat;

reacting the yttrium and aluminum oxide films at a temperature effective to form a single phase yttrium aluminum garnet (YAG) oxidation barrier coating directly on the surface of the bond coat; and depositing a top coat on the single phase YAG oxidation barrier coating.

2. A method according to claim 1 wherein the bond coat comprises MCrAlY, MAl, $M_3Al$ or combinations thereof wherein M comprises Ni, Pt, Co, NiCo or combinations thereof.

3. A method according to claim 1 wherein the bond coat comprises at least about 10% by wt aluminum.

4. A method according to claim 1 wherein the top coat comprises lanthanum phosphate.

5. A method according to claim 4 wherein the lanthanum phosphate has a thermal conductivity of about 1.5 to about 2.0 w/m·K at about 600 to about 700° C. and a density of about 4.0 to about 6.0 g/cm$^3$.

6. A method according to claim 4 wherein the lanthanum phosphate is produced by reacting aqueous mixtures of lanthanum nitrate and alkyl phosphates at temperatures below about 130° C. to form a lanthanum phosphate powder; and densifying the lanthanum phosphate powder by sintering at temperatures of from about 1400 to about 1550° C. and/or hot-pressing at temperatures of from about 1300 to about 1450° C.

7. A method according to claim 1 wherein the oxidation barrier coating comprises a thickness of about 0.5 to about 2 μm.

8. A method according to claim 1 wherein the oxidation barrier coating comprises nano-sized, bonded primary grains of YAG comprising a thickness of from about 500 nm to about 1000 nm.

9. A method according to claim 1 wherein the yttrium oxide and/or the aluminum oxide comprise a thickness of about 0.5 to 1 μm.

10. A method according to claim 1 wherein the yttrium oxide and aluminum oxide films are deposited as alternating layers onto the bond coat.

11. A method according to claim 1 further comprising heating at a temperature of from about 1000° C. to about 1200° C. prior to depositing the top coat.

12. A method according to claim 1 wherein the superalloy substrate comprises nickel.

13. A method of forming a coated alloy comprising:

providing a superalloy substrate;

applying a bond coat onto the superalloy substrate, wherein the bond coat comprises a surface layer comprising a preformed aluminum oxide film;

depositing an yttrium oxide film onto the surface layer of the bond coat;

reacting the yttrium oxide film and the preformed aluminum oxide film at a temperature effective to form a single phase yttrium aluminum garnet (YAG) oxidation barrier coating directly on the surface of the bond coat; and depositing a top coat onto the single phase YAG oxidation barrier coating, wherein the top coat comprises rare earth phosphates.

14. A method according to claim 13 wherein the yttrium oxide film comprises yttria ($Y_2O_3$), YAM ($Y_4Al_2O_9$), YAP ($YAlO_3$), yttrium aluminates, or combinations thereof.

15. A method according to claim 13 wherein the preformed aluminum oxide film comprises a thickness of from about 0.1 to about 1 μm.

16. A method according to claim 13 further comprising heating at a temperature of from about 1000° C. to about 1200° C. prior to depositing the top coat.

17. A method according to claim 13 wherein the superalloy substrate comprises nickel.

18. A method according to claim 13 wherein the top coat comprises lanthanum phosphate.

19. A method according to claim 18 wherein the lanthanum phosphate is produced by reacting aqueous mixtures of lanthanum nitrate and alkyl phosphates at temperatures below about 130° C. to form a lanthanum phosphate powder; and densifying the lanthanum phosphate powder by sintering at temperatures of from about 1400 to about 1550° C. and/or hot-pressing at temperatures of from about 1300 to about 1450° C.

20. A method of forming a coated alloy comprising:

providing a superalloy substrate;

applying a bond coat comprising aluminum onto the superalloy substrate;

depositing an yttrium oxide film on the surface of the bond coat;

reacting the yttrium oxide film and the aluminum in the bond coat in an oxidizing atmosphere at a temperature effective to form a single phase yttrium aluminum garnet (YAG) oxidation barrier coating directly on the surface of the bond coat; and depositing a top coat on the single phase YAG oxidation barrier coating, wherein the top coat comprises rare earth phosphates.

21. A method according to claim 20 further comprising heating at a temperature of from about 1000° C. to about 1200° C. prior to depositing the top coat.

22. A method according to claim 20 wherein the superalloy substrate comprises nickel.

23. A method of claim 20 wherein the top coat comprises lanthanum phosphate.

24. A method according to claim 23 wherein the lanthanum phosphate is produced by reacting aqueous mixtures of lanthanum nitrate and alkyl phosphates at temperatures below about 130° C. to form a lanthanum phosphate powder; and densifying the lanthanum phosphate powder by sintering at temperatures of from about 1400 to about 1550° C. and/or hot-pressing at temperatures of from about 1300 to about 1450° C.

* * * * *